US009719358B2

(12) United States Patent
Neale et al.

(10) Patent No.: US 9,719,358 B2
(45) Date of Patent: Aug. 1, 2017

(54) COOLING OF TURBINE BLADES

(71) Applicant: ROLLS-ROYCE plc, London (GB)

(72) Inventors: Christopher Neale, Bristol (GB); Marta Villasante Llarena, Bristol (GB)

(73) Assignee: ROLLS-ROYCE plc, London (GB)

( * ) Notice: Subject to any disclaimer, the term of this patent is extended or adjusted under 35 U.S.C. 154(b) by 0 days.

(21) Appl. No.: 15/140,035

(22) Filed: Apr. 27, 2016

(65) Prior Publication Data

US 2016/0341049 A1 Nov. 24, 2016

(30) Foreign Application Priority Data

May 22, 2015 (GB) ..... 1508795.0

(51) Int. Cl.
*B22C 9/10* (2006.01)
*B22C 9/24* (2006.01)
(Continued)

(52) U.S. Cl.
CPC ..... *F01D 5/187* (2013.01); *B22C 9/10* (2013.01); *B22C 9/101* (2013.01); *B22C 9/24* (2013.01); *B22D 25/02* (2013.01); *B22D 29/001* (2013.01); *B22D 30/00* (2013.01); *F01D 5/186* (2013.01); *F05D 2220/32* (2013.01); *F05D 2230/21* (2013.01); *F05D 2230/211* (2013.01)

(58) Field of Classification Search
CPC . F01D 5/186; F01D 5/187; B22C 9/10; B22C 9/24; B22C 9/064; B22D 25/02; B22D 27/045
USPC ..... 164/516–529, 122.1, 122.2, 369, 370, 164/397–399
See application file for complete search history.

(56) References Cited

U.S. PATENT DOCUMENTS 6,243,948 B1 * 6/2001 Lee ..... B23P 6/002 29/402.05
6,554,572 B2 * 4/2003 Rinck ..... F01D 5/141 29/889.1
(Continued)

FOREIGN PATENT DOCUMENTS

EP 1258597 A2 11/2002
EP 1288436 A2 3/2003
EP 1759788 A2 3/2007

OTHER PUBLICATIONS

Oct. 19, 2016 Search Report issued in European Patent Application No. 16 16 7125.
(Continued)

*Primary Examiner* — Kevin E Yoon
(74) *Attorney, Agent, or Firm* — Oliff PLC

(57) ABSTRACT

A method for casting a turbine blade body comprises; providing a mold defining the external geometry of the blade body; providing a core defining an internal geometry of the blade body, the core comprising a main body defining an internal chamber of the blade body and having a root end and a tip end and a plurality of pedestals defining an array of cooling channels extending from the internal chamber; casting a molten material between the mold and the core; and removing the core after the molten material has solidified, wherein the pedestals are arranged in a single row starting from the root end to a mid-portion of the main body branching into multiple and divergent rows towards the tip end of the body.

12 Claims, 12 Drawing Sheets

(51) Int. Cl.

| | |
|---|---|
| ***B22D 25/02*** | (2006.01) |
| ***F01D 5/18*** | (2006.01) |
| ***B22D 29/00*** | (2006.01) |
| ***B22D 30/00*** | (2006.01) |

(56) References Cited

U.S. PATENT DOCUMENTS

| | | | | |
|---|---|---|---|---|
| 6,609,891 | B2 * | 8/2003 | Leeke | F01D 5/186 415/115 |
| 6,668,906 | B2 * | 12/2003 | Burd | B22C 9/10 164/302 |
| 7,008,186 | B2 * | 3/2006 | Heeg | F01D 5/186 415/115 |
| 7,172,012 | B1 * | 2/2007 | Memmen | B22C 7/02 164/369 |
| 7,249,934 | B2 * | 7/2007 | Palmer | F01D 5/186 416/97 R |
| 7,306,026 | B2 * | 12/2007 | Memmen | B22C 7/02 164/361 |
| 2009/0317258 | A1 | 12/2009 | Tibbott et al. | |
| 2013/0230402 | A1 | 9/2013 | Levine et al. | |
| 2014/0219816 | A1 | 8/2014 | Plante et al. | |

OTHER PUBLICATIONS

Nov. 10, 2015 Search Report issued in British Patent Application No. 1508795.0.

* cited by examiner

COOLING OF TURBINE BLADES

FIELD OF DISCLOSURE

The present disclosure concerns the cooling of turbine blades. More particularly, the invention concerns the positioning of cooling holes in a turbine blade for use in a gas turbine engine.

BACKGROUND TO THE INVENTION

In a gas turbine engine, ambient air is drawn into a compressor section. Alternate rows of stationary and rotating aerofoil blades are arranged around a common axis, together these accelerate and compress the incoming air. A rotating shaft drives the rotating blades. Compressed air is delivered to a combustor section where it is mixed with fuel and ignited. Ignition causes rapid expansion of the fuel/air mix which is directed in part to propel a body carrying the engine and in another part to drive rotation of a series of turbines arranged downstream of the combustor. The turbines share rotor shafts in common with the rotating blades of the compressor and work, through the shaft, to drive rotation of the compressor blades.

It is well known that the operating efficiency of a gas turbine engine is improved by increasing the operating temperature. The ability to optimise efficiency through increased temperatures is restricted by changes in behaviour of materials used in the engine components at elevated temperatures which, amongst other things, can impact upon the mechanical strength of the blades and a rotor disc which carries the blades. This problem is addressed by providing a flow of coolant through and/or over the turbine rotor disc and blades.

It is known to take off a portion of the air output from the compressor (which is not subjected to ignition in the combustor and so is relatively cooler) and feed this to surfaces in the turbine section which are likely to suffer damage from excessive heat. Typically the cooling air is delivered adjacent the rim of the turbine disc and directed to a port which enters the turbine blade body and is distributed through the blade, typically by means of a labyrinth of channels extending through the blade body. Cooling of blade surfaces is aided by impingement cooling wherein small cooling holes extend from the channels through internal walls of the blade body and cause jets of air to impinge on the appropriate surfaces. For example (but without limitation) impingement cooling is often used to cool the leading edge passages of an aerofoil.

Turbine blades are known to be manufactured by casting methods. A mould defines an external geometry of the turbine and a core is inserted into the mould to define the internal geometry, molten material (typically a ferrous or non-ferrous alloy) is then cast between the mould and the core and the core subsequently is removed, for example by leaching. The core can include arrays of pedestals which define the arrangement of cooling holes in surfaces of the turbine blade.

Arrays of holes are designed to provide optimum cooling of a surface. Existing designs feature single rows of holes (an example is disclosed in US 2009/0317258); staggered rows and grid formations. Radial stresses in a blade body are mainly driven by centripetal loads caused by blade rotation. From the perspective of blade design, to minimise stresses in the impingement holes it is advantageous to employ a single row of holes aligned with the radial stress field in the impingement web.

SUMMARY OF THE INVENTION

According to a first aspect there is provided a method for casting a turbine blade body, the method comprising;

providing a mould defining the external geometry of the blade body;

providing a core defining an internal geometry of the blade body, the core comprising a main body defining an internal chamber of the blade body and having a root end and a tip end and a plurality of pedestals defining an array of cooling channels extending from the internal chamber;

casting a molten material between the mould and the core; and removing the core after the molten material has solidified, wherein the pedestals are arranged in a single row starting from the root end of the main body branching into multiple rows which extend towards the tip end of the body.

The branching may occur at any position in the mid-portion between the root and tip, for example, a branch may occur closer to the root end. In some embodiments, the branch may occur between about 20% and 80% of the distance between the root and tip ends, for example between 30% and 70%. Optimal positions for branching may vary with blade geometry and the anticipated working environment for the blade body. Optionally, the multiple rows diverge from each other adjacent the branch. Divergent rows may turn back to a parallel configuration as they approach the tip end. Alternatively, branched rows may diverge continuously towards the tip end.

Whilst desirable from a blade design perspective, from a casting perspective a single row of holes presents a potential risk. To ensure conforming geometry, it is essential that the cores around which the blade body is cast do not break during casting. During casting, significant bending moments may be applied to the pedestals by the molten alloy, for example to the leading edge passage, which may lead to breakage of the pedestals. Compared to double rows of pedestals, single rows have much less bending stiffness and are consequently more prone to breakage. Hence it is considered to be advantageous for casting to use double rows of pedestals. However, from a blade design perspective, inadequately spaced double rows of cooling holes are considerably more susceptible to complex radial stress fields and are consequently less desirable than single rows.

The present invention provides blade body designs which are optimised to both limit impingement stresses in the holes and enable manufacture using a core which has a reduced susceptibility to fail due to adverse bending moments arising in the molten phase of the casting process.

The number of branches is conveniently two. In one simple embodiment, the arrangement of pedestals branches into a pair of rows arranged symmetrically about a centreline which passes through the single row. In other embodiments branched rows are arranged asymmetrically about a centreline which passes through the single row.

The pedestals may all have the same cross sectional area. Optionally, one or more of the pedestals may have a larger cross sectional area than the remaining pedestals. Pedestals of larger cross sectional area may be biasedly located towards the tip end of the core.

In some embodiments, the cross sectional area of the pedestals may gradually increase from the root end to the tip end of the arrangement. In some examples of such embodiments, some or all of the pedestals may be grouped into numbers of pedestals with equal cross sectional areas.

In some embodiments, pedestals of larger cross sectional area are randomly dispersed between pedestals of relatively smaller cross section.

In some embodiments, a pedestal of larger cross section than the others is positioned at each of the root and tip end of the pedestal arrangement.

Radial loads in blade cooling channels and holes are primarily driven by centripetal forces as a result of the blade rotation about the engine axis. Consequently, radial loads are greatest towards the root of the blade and reduce towards the tip as the amount of supported mass decreases to zero. Hence, for a cavity of uniform thickness, the most highly stressed impingement holes (cooling channels) will be located at the most inboard location and the lowest stressed holes will be at the most outboard location.

The invention optimises the arrangement of holes to satisfy both stress and manufacturing requirements. The lower portion (root end) of holes is in a single row which is optimal for the stress shielding effect. As radial loads reduce moving outboard, a stagger can be slowly introduced. This enables provision of improved bending stiffness of the pedestal array towards the tip end of the core to reduce core breakage risk during casting.

By arranging the pedestals/holes as per the invention, stresses in the highest risk holes can be reduced in the blade body whilst maintaining bending stiffness in a large portion of the core, reducing the risk of core breakage during casting.

This avoids prior known means of reducing hole stresses such as increasing web thickness, which will lead to additional blade mass. This is unfavourable due to the downstream impacts on the turbine sub-system.

The pedestals (and hence the holes in the blade body) may have any practical cross-sectional shape. For example (but without limitation) the cross-sectional shape is circular, elliptical or racetrack. Preferably the cross-sectional shape does not include tight radii. The pedestals may be inclined with respect to a surface of the main core body resulting in inclined cooling channels in the walls of the cast component.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DESCRIPTION OF THE DRAWINGS

Embodiments will now be described by way of example only, with reference to the Figures, in which.

DETAILED DESCRIPTION OF SOME EMBODIMENTS OF THE INVENTION

Figure 1:
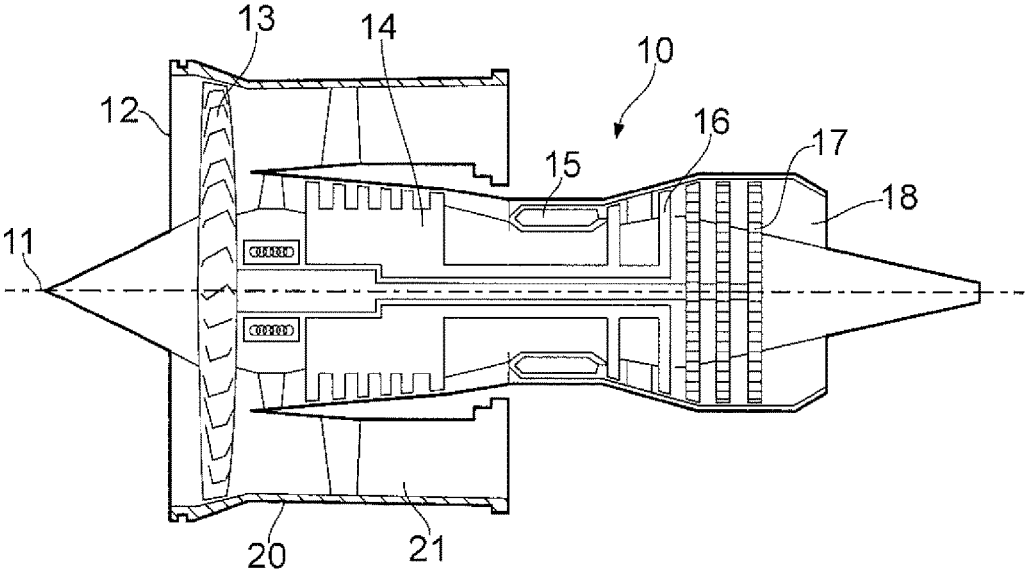
FIG. 1 is a sectional side view of a gas turbine engine.

With reference to FIG. 1, a gas turbine engine is generally indicated at 10, having a principal and rotational axis 11. The engine 10 comprises, in axial flow series, an air intake 12, a propulsive fan 13, a high-pressure compressor 14, combustion equipment 15, a high-pressure turbine 16, a low-pressure turbine 17 and an exhaust nozzle 18. A nacelle 20 generally surrounds the engine 10 and defines the intake 12.

The gas turbine engine 10 works in the conventional manner so that air entering the intake 12 is accelerated by the fan 13 to produce two air flows: a first air flow into the high-pressure compressor 14 and a second air flow which passes through a bypass duct 21 to provide propulsive thrust. The high-pressure compressor 14 compresses the air flow directed into it before delivering that air to the combustion equipment 15.

In the combustion equipment 15 the air flow is mixed with fuel and the mixture combusted. The resultant hot combustion products then expand through, and thereby drive the high and low-pressure turbines 16, 17 before being exhausted through the nozzle 18 to provide additional propulsive thrust. The high 16 and low 17 pressure turbines drive respectively the high pressure compressor 14 and the fan 13, each by suitable interconnecting shaft.

Other gas turbine engines to which the present disclosure may be applied may have alternative configurations. By way of example such engines may have an alternative number of interconnecting shafts (e.g. three) and/or an alternative number of compressors and/or turbines. Further the engine may comprise a gearbox provided in the drive train from a turbine to a compressor and/or fan.

The blades of turbines 16 and 17 are subjected to extremes of temperature by hot gases expelled from the combustion equipment 15. Relatively cool air from the compressor 14 is taken off upstream of the combustion equipment and directed to the blades for use as a cooling fluid. The blades can be provided with multiple internal channels and arrays of cooling channels in surfaces affected by the heat. The blades can be manufactured using methods in accordance with the invention.

Figures 2A, 2B, 2C:
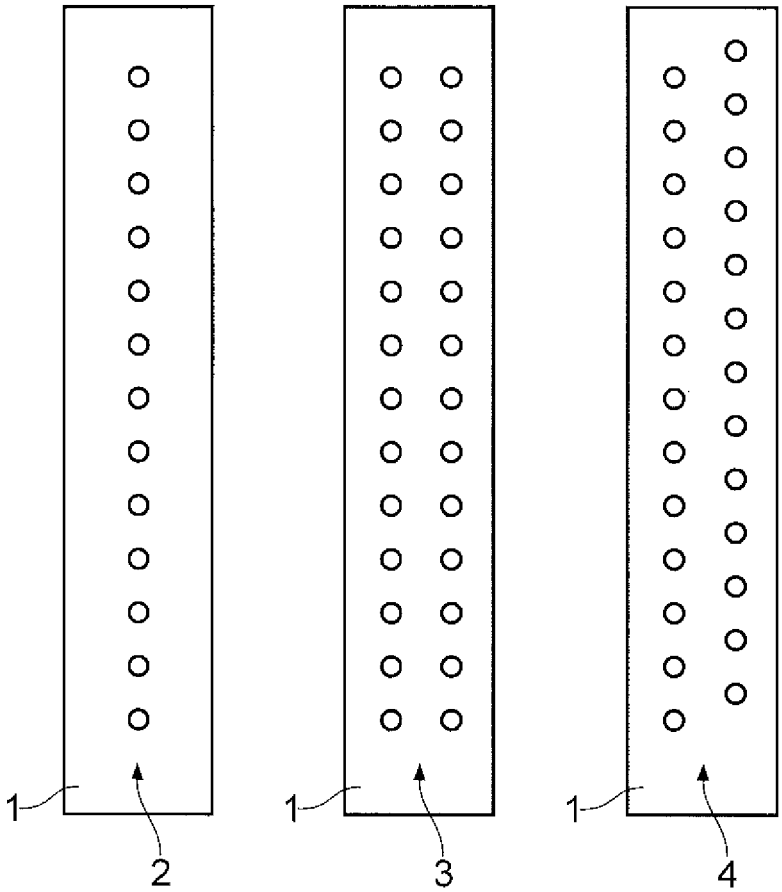
FIG. 2a FIG. 2b FIG. 2c PRIOR ART
FIG. 2*a* shows a first array of holes known to be used in turbine blades of the prior art.
FIG. 2*b* shows a second array of holes known to be used in turbine blades of the prior art.
FIG. 2*c* shows a third array of holes known to be used in turbine blades of the prior art.
Figure 14:
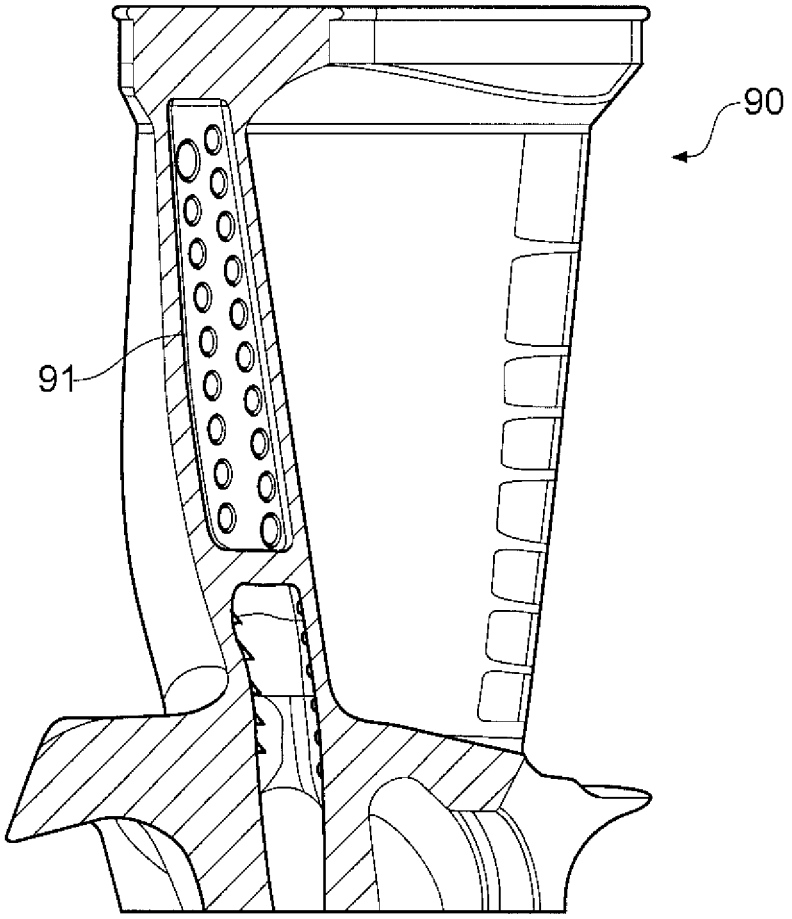
FIG. 14 (Prior Art)
FIG. 14 illustrates a turbine blade body including a leading edge through which cooling channels can be provided in accordance with methods of the present invention.

FIGS. 2*a*, 2*b* and 2*c* show arrays of cooling holes known to be provided in turbine blades of the prior art, for example along the leading edge of the blade. FIG. 14 illustrates a prior art blade exhibiting such an array of holes. It will be appreciated that the arrays of holes are achieved using cores having pedestals arranged in similar arrays, the blade body being cast between a mould defining its external geometry and the core. As discussed above, these arrays have been chosen to be at reduced risk of cracking due to radial stress fields to which they are subjected when the turbine blade is in use. Complex stress fields with a predominant radial component are avoided by providing the single row of holes substantially in line with the stress field and, where more than one row is present, separating the rows by sufficient distance that the stress fields experienced by each row do not interfere with each other to create a more complex stress field. FIG. 2*a* shows a blade surface 1 having a single row 2 of equally sized, equally spaced holes. FIG. 2*b* shows an array 3 of two parallel aligned rows, each row comprising equally sized, equally spaced holes. FIG. 2*c* shows an array 4 of two parallel aligned rows, each row comprising equally sized, equally spaced holes, but the rows are staggered.

Figure 3A:
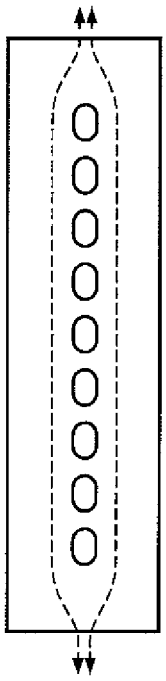
FIG. 3*a* shows a radial stress field experienced by a first array of holes known to be used in turbine blades of the prior art.
Figure 3B:
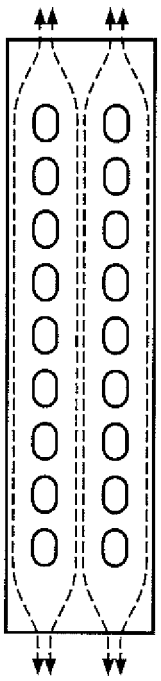
FIG. 3*b* shows a radial stress field experienced by a second array of holes known to be used in turbine blades of the prior art.
Figure 3C:
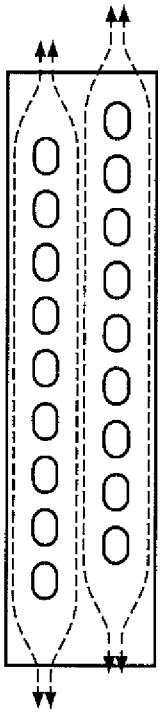
FIG. 3*c* shows a radial stress field experienced by a third array of holes known to be used in turbine blades of the prior art.
Figure 3D:
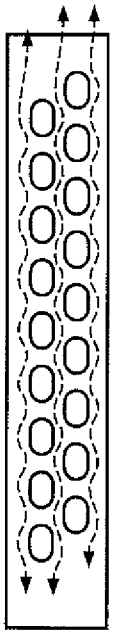
FIG. 3*d* shows a radial stress field experienced by a fourth array of holes known to be used in turbine blades of the prior art.

FIGS. 3*a*, 3*b* and 3*c* show the stress fields experienced by the arrays 2, 3 and 4 of FIGS. 2*a*, 2*b* and 2*c*. FIG. 3*d* shows a more complex stress field which results from positioning the rows of array 4 more closely together.

Figure 4A:
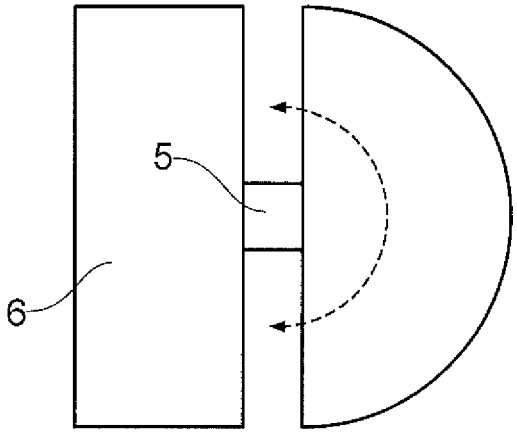
FIG. 4*a* shows a single pedestal of a core and illustrates the bending moment experienced by the pedestal during the molten phase of casting.
Figure 4B:
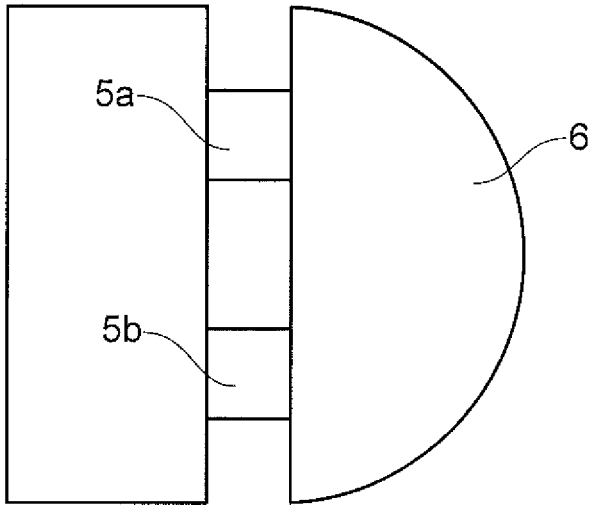
FIG. 4*b* shows a two row pedestal arrangement of a core.

FIG. 4*a* shows the bending moments (dashed line arrow) to which a single pedestal 5 of a core 6 is subjected. FIG. 4*b* shows a pair of pedestals 5*a*, 5*b* anchored in a core 6. It will be appreciated the two anchored pedestals 5*a*, 5*b* are far better placed to resist bending stresses caused by the bending moments than the single pedestal 5 of FIG. 4*a*.

Figure 5A:
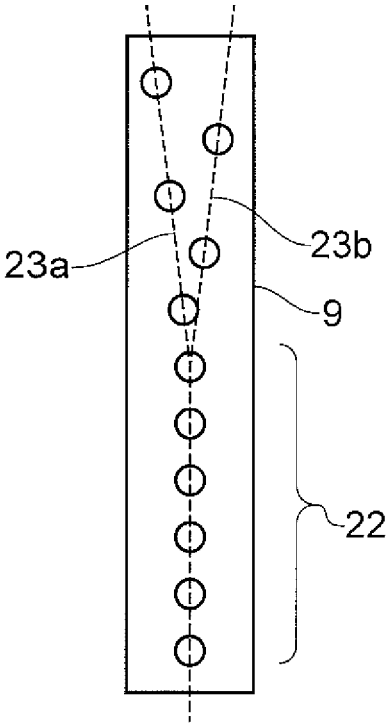
FIG. 5*a* shows a first embodiment of an array of holes in a turbine blade made in accordance with a method of the invention.

FIG. 5*a* shows a first array of holes achievable by a method in accordance with the invention. It will be appreciated that pedestals for creating the holes would be arranged in a similar array on a core body used to cast the blade. The array has two distinct sections; the first is a single row 22 of equally sized and equally spaced holes which extend from a root end to a mid-section of a blade surface 9. In the mid-section, the array branches in a Y shaped configuration providing a pair of divergent branches 23*a* and 23*b*. The holes of branches 23*a* and 23*b* are spaced further apart than in the single row 22 and are staggered with respect to one another.

Figure 5B:
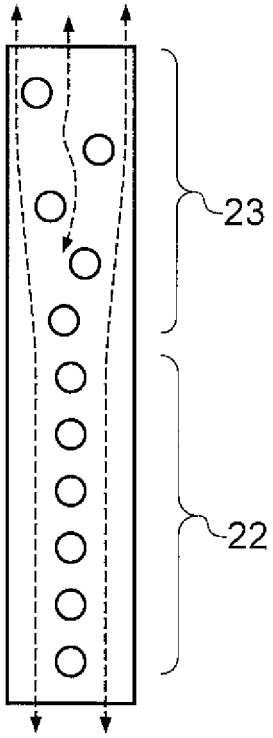
FIG. 5*b* shows the radial stress field experienced by the array of FIG. 5*a;*

The single row adjacent the root end provides maximum stress shielding for the holes in the blade surface, whilst the branched section of the array provides for improved bending stiffness of the pedestal array in the core. FIG. 5*b* illustrates the stress field for the array of FIG. 5*a*. As can be seen, there is a smooth stress field for the single row of holes 22 where the load is highest and a more complex stress field in the mid-section to tip area where the load is lower, however the benefit of a greater bending stiffness in the pedestal array of the core provides a reduced risk of core damage and consequent component rejection during the molten phase of the casting process.

Figure 6:
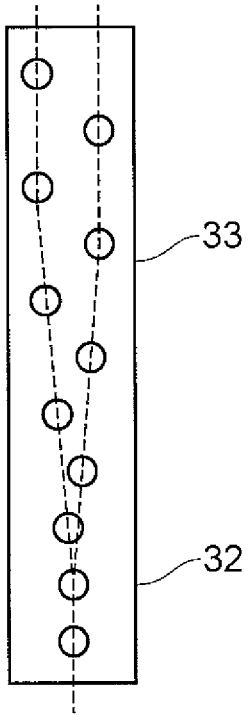
FIG. 6 shows a second embodiment of an array of holes in a turbine blade made in accordance with a method of the invention.

FIG. 6 shows a variant of the arrangement in FIG. 5*a*. As can be seen the single row 32 is shorter in length than in FIG. 5*a* and the branched section 33 diverges more gradually. The example shows an arrangement optimised further towards pedestal array bending stiffness than low stresses.

Figure 7:
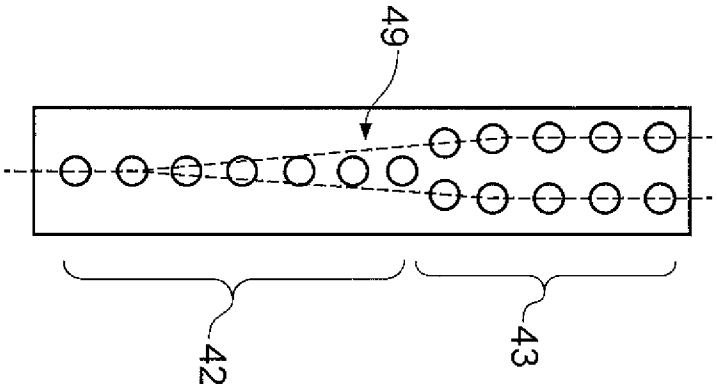
FIG. 7 shows a third embodiment of an array of holes in a turbine blade made in accordance with a method of the invention.

FIG. 7 shows another arrangement. The array has two distinct sections; the first is a single row 42 of equally sized and equally spaced holes which extends from a root end to a mid-section of a blade surface 49. In the mid-section, the array branches in a Y shaped configuration providing a pair of divergent branches 43. The holes of branches 43 are spaced similarly to those in the single row 42 and are symmetrically aligned about a centre line passing through the single row 42. The high density of holes in the branched portion can serve to maximise cooling performance and/or improve bending stiffness in the pedestal array.

Figure 8:
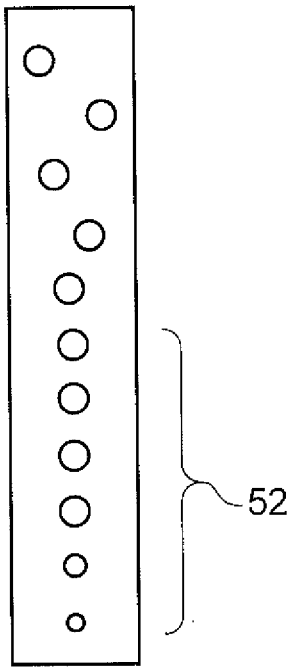
FIG. 8 shows a fourth embodiment of an array of holes in a turbine blade made in accordance with a method of the invention.

FIG. 8 shows another arrangement. The arrangement is broadly similar to that of FIG. 5*a* but differs primarily in that in a region of the single row 52 towards the root end, the size of the holes is gradually reduced. This arrangement is beneficial in minimising stresses in the lowest holes utilising the stress shielding effect.

Figure 9:
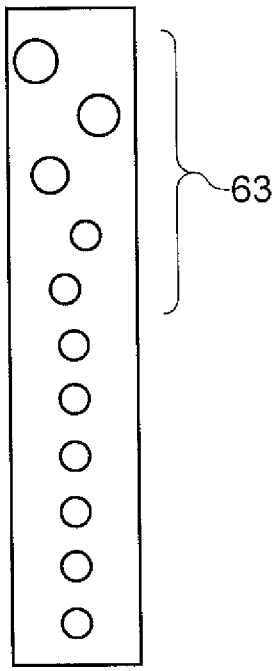
FIG. 9 shows a fifth embodiment of an array of holes in a turbine blade made in accordance with a method of the invention.

FIG. 9 shows another arrangement. The arrangement is broadly similar to that of FIG. 5*a* but differs primarily in that in a region of the branched section 63 towards the tip end, the size of holes is gradually increased. This arrangement is beneficial in maximising bending stiffness of the pedestal array and strengthening the branched section of the array.

Figure 10:
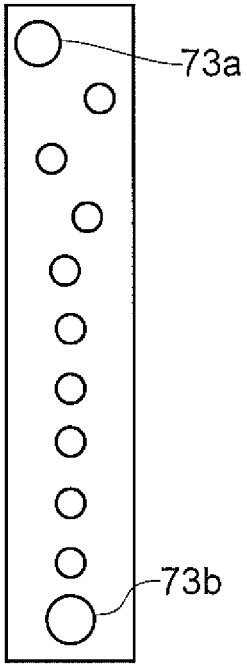
FIG. 10 shows a sixth embodiment of an array of holes in a turbine blade made in accordance with a method of the invention.

FIG. 10 shows another arrangement. The arrangement is broadly similar to that of FIG. 5*a* but differs primarily in that "anchor" holes 73*a*, 73*b* of larger diameter than the rest are positioned one adjacent the tip end and one adjacent the root end. The "anchor" holes provide extra stiffness and strength to the extreme ends of the pedestal array to avoid 'pedestal unzipping'.

Figure 11:
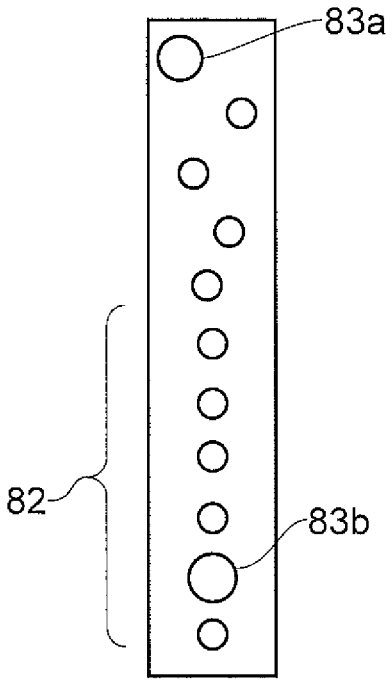
FIG. 11 shows a seventh embodiment of an array of holes in a turbine blade made in accordance with a method of the invention.
Figure 12:
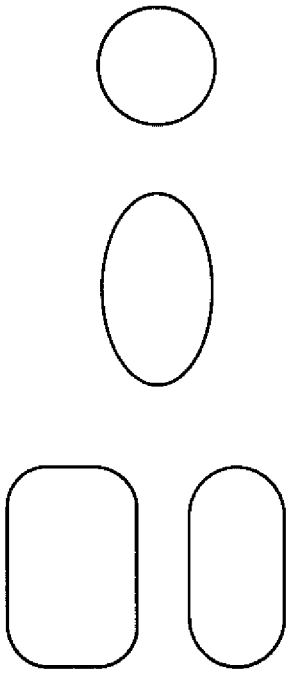
FIG. 12 shows some example cross-sectional shapes for pedestals/holes of the present invention.

FIG. 11 shows an arrangement broadly similar to that of FIG. 10 but differs in that a first anchor hole 83*a* is positioned immediately adjacent the tip end and a second anchor hole 83*b* is positioned in a mid-section of single row 82. This arrangement is beneficial in providing stress shielding to the lowest hole whilst also providing some 'unzipping' protection. It provides a balance between the objectives of pedestal array bending stiffness/strength and reduced hole stress. FIG. 12 shows examples of cross sectional shapes for holes and pedestals already discussed in relation to the method of the invention. Hole selection may be based on cooling/stress/manufacturing compromises.

Figure 13:
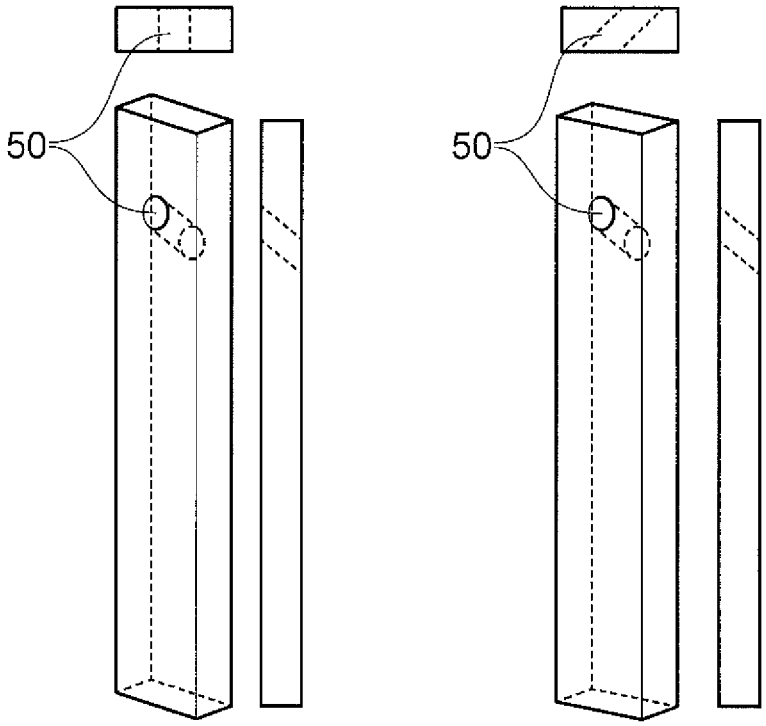
FIG. 13 shows examples of how pedestals/holes of the invention may be inclined with respect to a planar surface.

FIG. 13 shows a wall section in a 3D perspective view illustrating a channel associated with the holes already discussed in relation to the method of the invention. It will be seen the channel 50 is inclined with respect to external surfaces of the wall. It will be appreciated that pedestals of a core used in methods of the invention can be provided at appropriate angles in order to provide such inclined channels. In the left hand image, it can be seen the channel is radially inclined. In the right hand figure, the channel is both radially and in-plane inclined.

FIG. 14 shows a turbine blade 90 as known from the prior art. The blade has a leading edge surface 91 into which an array of cooling channels is provided. It will be appreciated that the array shown on surface 91 can be replaced with the arrays described in the examples of the invention discussed above in a turbine blade made according to a method of the invention.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

What is claimed is:

1. A method for casting a turbine blade body, the method comprising;

providing a mould defining the external geometry of the blade body;

providing a core defining an internal geometry of the blade body, the core comprising a main body defining an internal chamber of the blade body and having a root end and a tip end and a plurality of pedestals defining an array of cooling channels extending from the internal chamber;

casting a molten material between the mould and the core; and removing the core after the molten material has solidified, wherein the pedestals are arranged in a single row starting from the root end to the main body branching into multiple rows towards the tip end of the body, the single row having a line of symmetry and all of the multiple rows branching to either side of the line of symmetry, and one or more of the pedestals has a larger cross sectional area than the remaining pedestals and a pedestal of larger cross sectional area is positioned at or near the root end of the core body.

2. A method as claimed in claim 1 wherein the number of branches is two.

3. A method as claimed in claim 2 wherein the arrangement of pedestals branches into a pair of rows arranged symmetrically about the line of symmetry.

4. A method as claimed in claim 2 wherein the arrangement of pedestals branches into a pair of rows arranged asymmetrically about the line of symmetry.

5. A method as claimed in claim 1, wherein a pedestal of larger cross sectional area is positioned at or near the tip end of the core body.

6. A method as claimed in claim 1, wherein some or all of the pedestals are grouped into numbers of pedestals with equal cross sectional areas.

7. A method as claimed in claim 1 wherein the pedestals have a cross-sectional shape selected from; circular, elliptical or race track.

8. A method as claimed in claim 1 wherein the pedestals are inclined to a surface of the main body and the resulting blade body includes channels which are inclined to surfaces of walls of the blade body.

9. A method as claimed in claim 1 wherein the single row branches at a position which is closer to the root end than to the tip end.

10. A method as claimed in claim 1 wherein the single row branches at a position in the range from 20% to 80% of the distance from the root end to the tip end.

11. A method as claimed in claim 10 wherein the single row branches at a position in the range from 30% to 70% of the distance from the root end to the tip end.

12. A method as claimed in claim 1 wherein the multiple rows diverge from the single row for at least part of the distance to the tip end.

* * * * *